US010316647B2

(12) United States Patent
Renshaw

(10) Patent No.: US 10,316,647 B2
(45) Date of Patent: Jun. 11, 2019

(54) REGULATION OF FLOW THROUGH A WELL TOOL SPRING

(71) Applicant: Halliburton Energy Services, Inc., Houston, TX (US)

(72) Inventor: William S. Renshaw, Edmonton (CA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 183 days.

(21) Appl. No.: 15/113,970

(22) PCT Filed: Feb. 24, 2014

(86) PCT No.: PCT/US2014/018065
§ 371 (c)(1),
(2) Date: Jul. 25, 2016

(87) PCT Pub. No.: WO2015/126428
PCT Pub. Date: Aug. 27, 2015

(65) Prior Publication Data

US 2016/0356148 A1 Dec. 8, 2016

(51) Int. Cl.
*E21B 43/12* (2006.01)
*E21B 47/09* (2012.01)
(Continued)

(52) U.S. Cl.
CPC ..... *E21B 47/091* (2013.01); *E21B 33/14* (2013.01); *E21B 34/10* (2013.01); *E21B 34/102* (2013.01);
(Continued)

(58) Field of Classification Search
CPC ..... E21B 47/091; E21B 33/14; E21B 34/10; E21B 34/102; E21B 43/08; E21B 43/12; E21B 47/024; E21B 47/185
See application file for complete search history.

(56) References Cited

U.S. PATENT DOCUMENTS 3,543,793 A 12/1970 Dollison
5,176,220 A 1/1993 Akkerman
(Continued)

FOREIGN PATENT DOCUMENTS

CN 202731847 U 2/2013
CN 103038445 A 4/2013
(Continued)

OTHER PUBLICATIONS

International Search Report issued in corresponding application No. PCT/US2014/018065 dated Nov. 24, 2014, 2 pgs.

*Primary Examiner* — Yong-Suk Ro
(74) *Attorney, Agent, or Firm* — Chamberlain Hrdlicka

(57) ABSTRACT

A flow restriction tool can include a closure device having positions in which flow is permitted through the tool, in one position a flow passage is open to the flow and the closure device blocks flow through another flow passage, and in another position both passages are open to the flow, and a biasing device which displaces the closure device to the former position in response to a flow rate being less than a predetermined level. A well tool string can include an orientation tool that intermittently permits flow through a wall of the tool string to transmit orientation data via pressure pulses in a flow passage through the string, and a flow restriction tool that permits flow through one flow area when a flow rate of the flow is less than a predetermined level, and permits flow through a larger flow area when the flow rate is increased.

20 Claims, 3 Drawing Sheets

(51) Int. Cl.

| | |
|---|---|
| ***E21B 47/18*** | (2012.01) |
| ***E21B 43/08*** | (2006.01) |
| ***E21B 47/024*** | (2006.01) |
| ***E21B 33/14*** | (2006.01) |
| ***E21B 34/10*** | (2006.01) |

(52) U.S. Cl.
CPC ..... *E21B 43/08* (2013.01); *E21B 43/12* (2013.01); *E21B 47/024* (2013.01); *E21B 47/185* (2013.01)

(56) References Cited

U.S. PATENT DOCUMENTS

| | | | |
|---|---|---|---|
| 5,443,129 | A | 8/1995 | Bailey et al. |
| 5,609,178 | A | 3/1997 | Hennig et al. |
| 6,176,327 | B1 | 1/2001 | Hearn |
| 6,378,612 | B1 | 4/2002 | Churchill |
| 2002/0060096 | A1 | 5/2002 | Brunnert |
| 2002/0105858 | A1 | 8/2002 | Winnacker |
| 2006/0175052 | A1 | 8/2006 | Tips |
| 2009/0078428 | A1 | 3/2009 | Ali |
| 2009/0199419 | A1 | 8/2009 | Hepburn |
| 2011/0108276 | A1 | 5/2011 | Spence et al. |
| 2011/0168410 | A1 | 7/2011 | Deboer |
| 2011/0214498 | A1 | 9/2011 | Rezgui et al. |
| 2012/0090856 | A1 | 4/2012 | Rogers et al. |
| 2012/0132289 | A1 | 5/2012 | Kolle |
| 2012/0181044 | A1 | 7/2012 | Nikiforuk |
| 2013/0133878 | A1 | 5/2013 | Urban |

FOREIGN PATENT DOCUMENTS

| | | | |
|---|---|---|---|
| RU | 1828893 | A1 | 7/1993 |
| RU | 2426862 | C1 | 8/2011 |
| WO | 99/47789 | A1 | 9/1999 |
| WO | 01/06086 | A1 | 1/2001 |

REGULATION OF FLOW THROUGH A WELL TOOL SPRING

TECHNICAL FIELD

This disclosure relates generally to equipment utilized and operations performed in conjunction with a subterranean well and, in one example described below, more particularly provides for regulation of flow through a well tool string.

BACKGROUND

Recent advances in casing/liner rotational orientation in a well allow for pressure pulse telemetry to communicate orientation data to surface via encoded negative pressure pulses. However, a pressure differential is needed between an interior and an exterior of the casing/liner in order to produce the pressure pulses. For this reason and others, advancements are continually needed in the art of regulating flow through a well tool string. Such advancements may be useful whether or not a casing/liner is rotationally oriented using pressure pulse telemetry to encode orientation data on negative pressure pulses.

DETAILED DESCRIPTION

Figure 1:
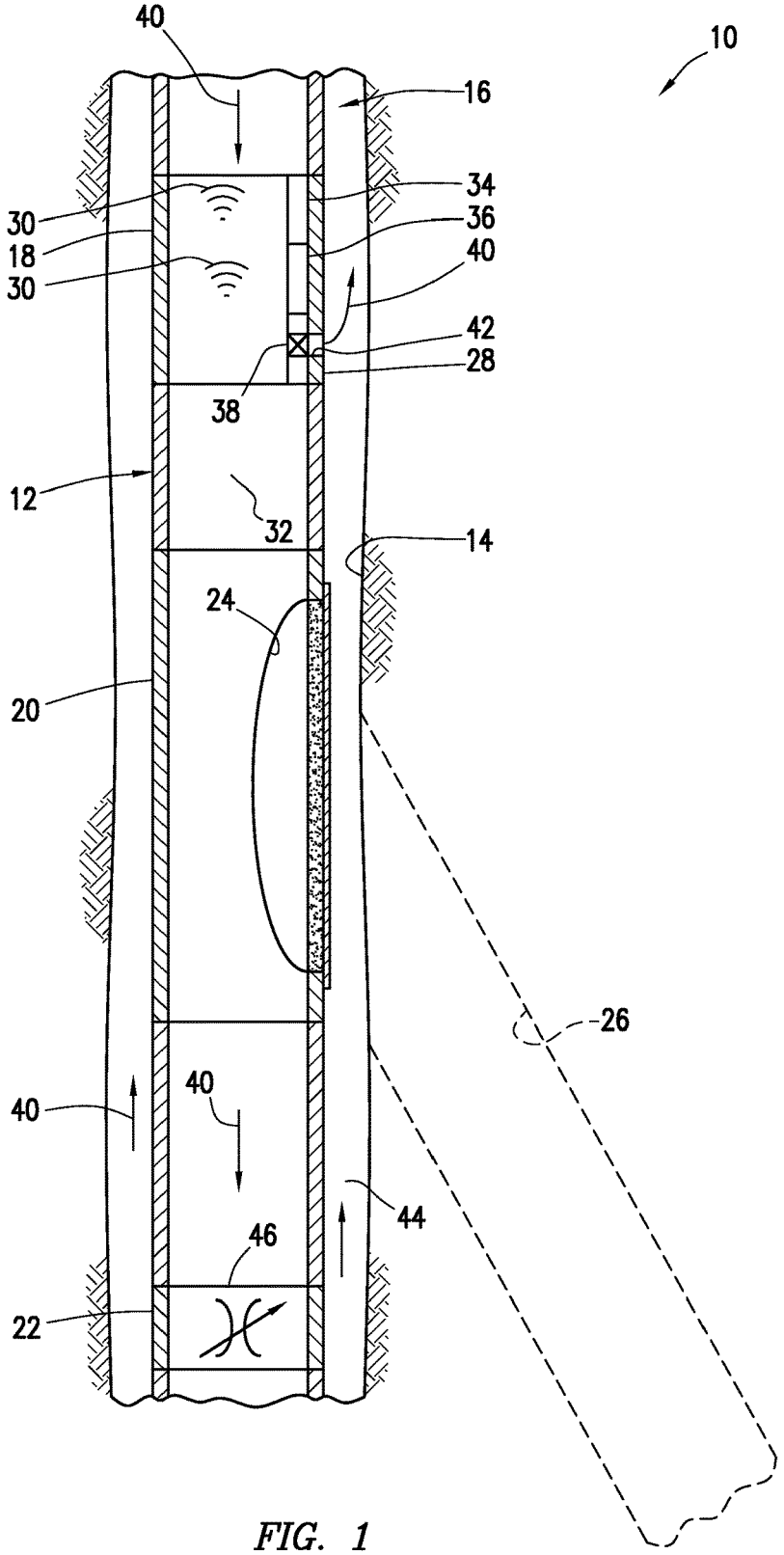
FIG. 1 is a representative partially cross-sectional view of a well system and associated method which can embody principles of this disclosure.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a well tool string 12 is being positioned in a wellbore 14. The well tool string 12 is part of a casing or liner string 16 that forms a protective lining for the wellbore 14.

The tool string 12 in this example includes an orientation tool 18, a window joint 20 and a flow restriction tool 22. The orientation tool 18 and the flow restriction tool 22 are used to rotationally or azimuthally orient a pre-formed window 24 of the window joint 20, so that a branch or lateral wellbore 26 can be drilled in a desired direction through the window. In this example, the window 24 is closed off (for example, using a relatively easily drilled or milled through material, such as aluminum and/or composite material, etc.) prior to the lateral wellbore 26 being drilled.

As depicted in FIG. 1, the main or parent wellbore 14 is vertical and the branch or lateral wellbore 26 is inclined or deviated from vertical. However, in other examples, the wellbore 14 could be horizontal or inclined, and/or the wellbore 26 could be horizontal or vertical. The wellbore 14 could be a branch or lateral of another wellbore (not shown). Therefore, it should be clearly understood that the scope of this disclosure is not limited to any of the particular details of the system 10 and method as depicted in FIG. 1 or described herein.

The orientation tool 18 can be of the type that selectively permits and prevents flow through a wall 28 of the tool, to thereby produce pressure pulses 30 in a flow passage 32 extending longitudinally through the casing or liner string 16. Such pressure pulses 30 can be encoded with orientation data, and can be detected at a remote location (for example, at a surface location using a pressure sensor).

The orientation data can be decoded from the detected pressure pulses 30 at the remote location, thereby enabling personnel to verify whether the window 24 is in a desired orientation, or to determine how the casing or liner string 16 should be rotated in order to achieve the desired orientation. This decoding can be performed in real time (as the string 16 is being installed).

The orientation tool 18 in the FIG. 1 example includes an orientation sensor 34 (such as, a gyroscope, three-axis accelerometers, a gravity sensor, etc.), a controller/actuator 36 and a valve 38. The controller/actuator 36 operates the valve 38 in response to measurements made by the orientation sensor 34, so that the measurements (orientation data) are encoded on the pressure pulses 30.

In the FIG. 1 example, the pressure pulses 30 are negative pressure pulses, in that they comprise relatively short decreases in fluid pressure in the flow passage 32. The fluid pressure in the flow passage 32 is decreased by opening the valve 38, thereby allowing fluid flow 40 outward through an opening 42 in the wall 28 of the orientation tool 18.

A suitable orientation tool for use in the system 10 is a Casing Orientation Tool (COT) marketed by Intelligent Well Controls of Aberdeen, United Kingdom. However, other orientation tools can be used without departing from the principles of this disclosure.

In order for opening of the valve 38 to produce a sufficient decrease in fluid pressure in the flow passage 32 to be detected at the remote location, the fluid pressure in the flow passage should be sufficiently greater than fluid pressure external to the string 16. For this purpose, the tool string 12 includes the flow restriction tool 22 positioned downstream (with respect to the flow 40) from the orientation tool 18.

Although the flow restriction tool 22 is depicted in FIG. 1 as being opposite the window joint 20 from the orientation tool 18, in other examples the flow restriction tool could be between the orientation tool and the window joint, the flow restriction tool could be combined with the orientation tool and/or the window joint, etc. Thus, the scope of this disclosure is not limited to any particular arrangement, configuration or construction of the various elements of the well tool string 12.

The flow restriction tool 22 restricts the flow 40 to thereby increase pressure in the flow passage 32 upstream of the flow restriction tool. After passing through the flow restriction tool 22, the flow 40 exits a bottom (not shown) of the string 16 and returns to the surface via an annulus 44 formed between the string and the wellbore 14.

When the string 16 is properly oriented in the wellbore 14 (e.g., with the window 24 facing in a direction toward the desired lateral wellbore 26), it is desired to cement the string in the wellbore 14. During the cementing operation, flow through the passage 32 is preferably not substantially restricted, since it is not required to maintain a pressure differential from an interior to an exterior of the string 16. In addition, greater flow area through the flow restriction tool 22 is desirable during the cementing operation, so that the cement can be expeditiously placed where intended.

For this purpose (to reduce restriction to flow), the flow restriction tool 22 is capable of increasing a flow area through a variable flow restrictor 46 of the tool, in response to an increase in flow rate. In addition, the variable flow restrictor 46 can be reset so that, if the flow rate is subsequently decreased, the restriction to flow will again be increased. This prevents inadvertent (or even intentional) flow rate increases prior to or during the orienting operation from irreversibly reducing the restriction to flow through the flow restriction tool 22.

In addition, the variable flow restrictor 46 can be made of relatively easily drillable materials (such as, aluminum, composite materials, etc.). In this manner, after the cementing operation is concluded, the flow restriction tool 22 can conveniently be drilled through.

Figure 2:
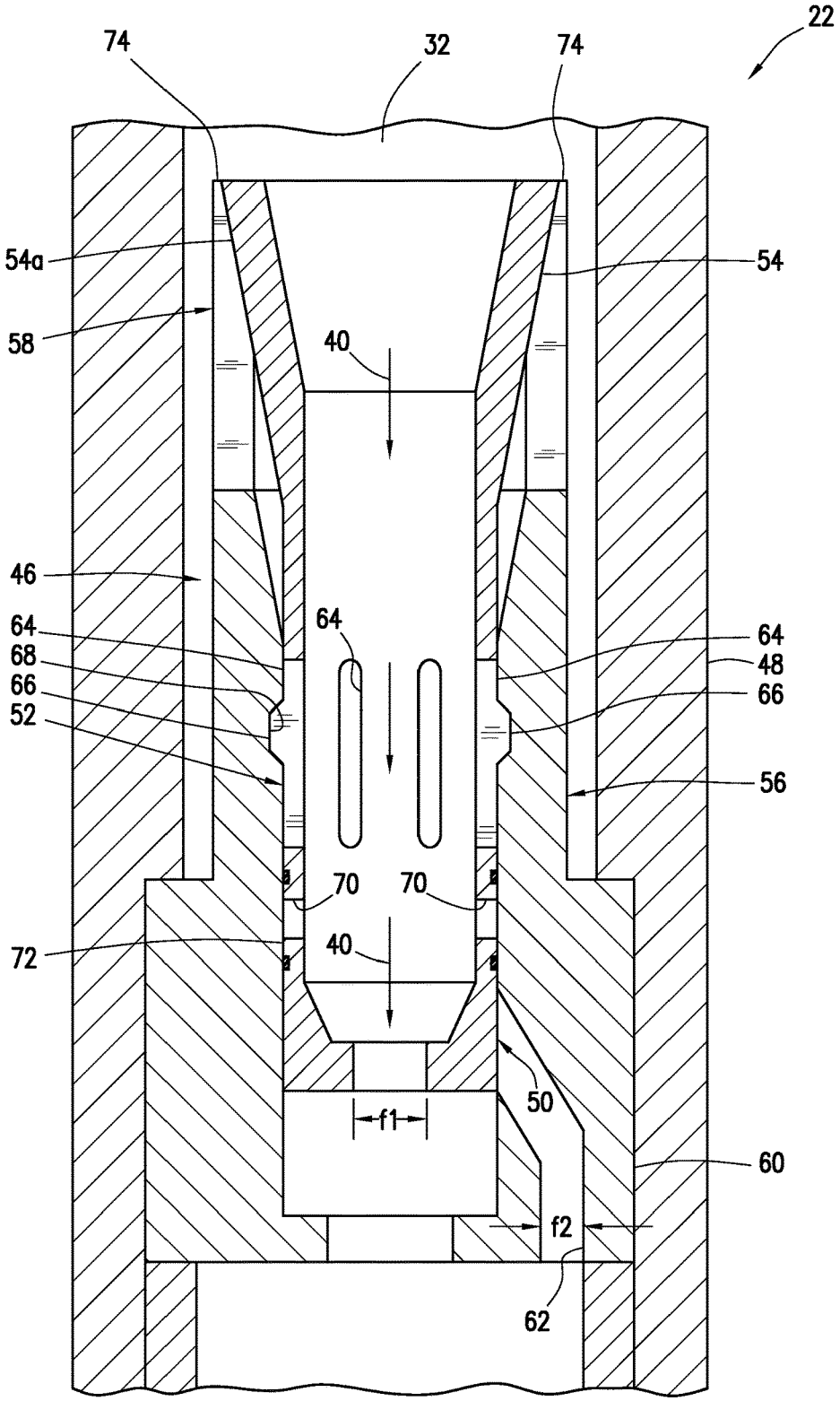
FIG. 2 is an enlarged scale representative cross-sectional view of a flow restriction tool that may be used in the system and method of FIG. 1, and which can embody the principles of this disclosure.
Figure 3:
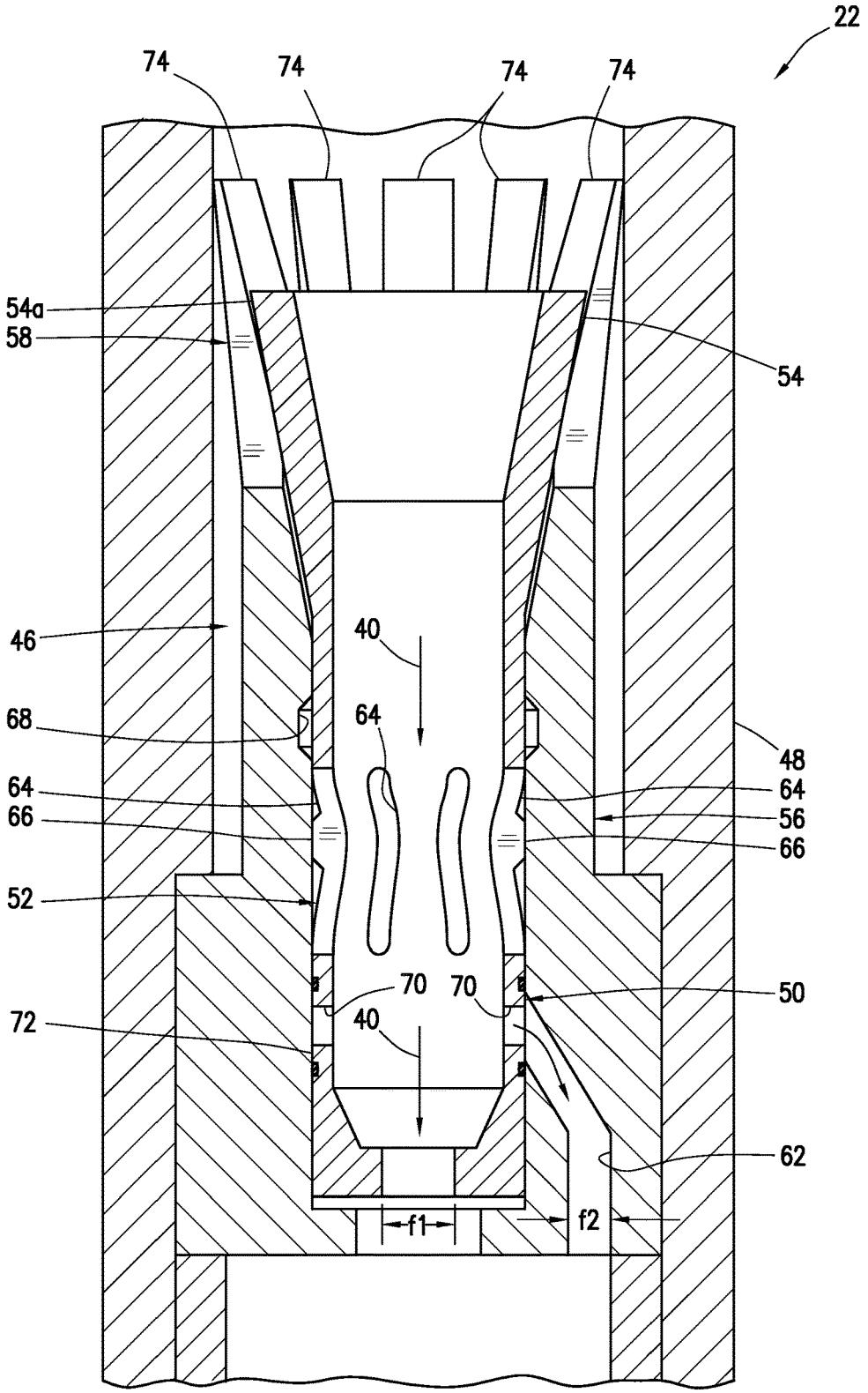
FIG. 3 is a representative cross-sectional view of the flow restriction tool in an increased flow area configuration thereof.

Referring additionally now to FIGS. 2 & 3, more detailed enlarged scale cross-sectional views of the flow restriction tool 22 are representatively illustrated. The flow restriction tool 22 may be used in the system 10 and method of FIG. 1, or it may be used in other systems and methods.

In the FIGS. 2 & 3 example, the variable flow restrictor 46 is contained within an outer housing assembly 48. As depicted in FIGS. 2 & 3, a closure device 50, a retaining device 52 and a frusto-conical wedge 54 are integrally formed and reciprocably disposed in an inner housing 56. The inner housing 56 comprises a biasing device 58 and a ported structure 60.

The closure device 50 has two positions in which it either blocks (see FIG. 2) or permits (see FIG. 3) flow 40 through a flow passage 62 formed through the structure 60. In both positions of the closure device 50, flow 40 is permitted longitudinally through the flow passage 32 (which extends longitudinally through the flow restriction tool 22).

In the position depicted in FIG. 2, the flow 40 cannot pass through a flow area of the passage 62, and so a total area available for flow longitudinally through the tool 22 is reduced, as compared to the position depicted in FIG. 3. Thus, a restriction to flow is increased in FIG. 2, as compared to that in FIG. 3.

In the FIG. 2 position, only a flow area f1 is available for the flow 40. In the FIG. 3 position, an additional flow area f2 is available for the flow 40. Thus, in FIG. 2 a total available flow area is f1, but in FIG. 3 the total available flow area is f1+f2.

To displace the closure device 50 from the FIG. 2 position to the FIG. 3 position, a flow rate of the flow 40 is increased. Since the flow area f1 through the closure device 50 is in this example a least available flow area of the passage 32, a pressure differential results across the closure device.

This pressure differential biases the closure device 50 downward (as viewed in FIG. 2) toward the FIG. 3 position. The retaining device 52 retains the closure device 50 in its FIG. 2 position, until the flow rate is greater than a predetermined level.

In the FIGS. 2 & 3 example, the retaining device 52 comprises multiple resilient collets 64. Each of the collets 64 has a radially enlarged projection 66 that releasably engages an annular recess 68 formed in the inner housing 56.

The projections 66 and the recess 68 are configured so that, as a biasing force acting on the closure device 50 due to the flow 40 through the flow area f1 increases, the collets 64 are increasingly deformed radially inward. When the predetermined flow rate is exceeded, the collets 64 are sufficiently deformed, so that the projections 66 are no longer engaged with the recess 68, and the closure device 50 can be displaced to the FIG. 3 position by the biasing force.

Although the retaining device 52 is described herein and illustrated in the drawings as comprising the resilient collets 64 and the recess 68, it will be appreciated that other types of retaining devices could be used instead. For example, a snap ring could be used. Thus, the scope of this disclosure is not limited to use of any particular type of retaining device.

In the FIG. 3 position, the flow 40 is permitted to pass through openings 70 formed through a generally tubular sleeve 72 of the closure device 50. The flow 40 can then pass through the passage 62 to the passage 32 below the flow restriction tool 22.

Note that displacement of the wedge 54 with the closure device 50 from the FIG. 2 position to the FIG. 3 position causes multiple resilient collets 74 formed on the inner housing 56 to be deformed radially outward. Because the deformed collets 74 are outwardly supported by a conical outer surface 54*a* of the wedge 54 in the FIG. 3 position, a biasing force exerted by the collets on the wedge longitudinally biases the wedge and the closure device 50 toward the FIG. 2 position.

Thus, the longitudinal biasing force exerted on the closure device 50 due to the flow 40 through the flow area f1 must be greater than the longitudinal biasing force exerted on the wedge 54 by the collets 74, in order to maintain the closure device in the FIG. 3 position. If the flow rate decreases below a predetermined level, the longitudinal biasing force exerted on the wedge 54 by the collets 74 will exceed the biasing force exerted on the closure device 50 due to the flow 40 through the flow area f1, and the closure device will displace back to the FIG. 2 position.

In this manner, the flow restriction tool 22 can be "reset," so that the total flow area through the tool is again only f1, and restriction to the flow 40 is increased. If it is desired to then decrease the restriction to the flow 40, the flow rate can again be increased, in order to displace the closure device 50 to the FIG. 3 position. Thus, the restriction to flow 40 can be conveniently and repeatedly increased and decreased by respectively decreasing and increasing the flow rate.

Although the biasing device 58 is described herein and depicted in the drawings as comprising the resilient collets 74 acting on the conical outer surface 54*a* of the wedge 54, it will be appreciated that other types of biasing devices could be used. For example, a compression spring or an extension spring could be used. Thus, the scope of this disclosure is not limited to use of any particular type of biasing device.

Although the flow restriction tool 22 is described above as being used in an operation wherein the window joint 20 is rotationally oriented in the wellbore 14, the scope of this disclosure is not limited to use of the flow restriction tool for any particular purpose. Other types of equipment (such as, whipstocks, etc.) could be oriented in a well using the flow restriction tool 22, and it is not necessary for the flow restriction tool to be used in a rotational orienting operation at all.

It may now be fully appreciated that the above disclosure provides significant advancements to the art of regulating flow through a well tool string. In examples described above, a flow area through the flow restriction device 22 can be increased and decreased repeatedly by respectively increasing and decreasing a flow rate of the flow 40.

In one aspect, a flow restriction tool 22 for use in a subterranean well is provided to the art by the above disclosure. In one example, the flow restriction tool 22 can comprise: a closure device 50 reciprocably displaceable between first and second positions in which flow 40 is permitted longitudinally through the flow restriction tool 22. In the first position (see FIG. 2) a first flow passage 32 is open to the flow 40 and the closure device 50 blocks the flow 40 through a second flow passage 62. In the second position (see FIG. 3) the first and second flow passages 32, 62 are open to the flow 40. A biasing device 58 displaces the closure device 50 to the first position in response to a flow rate of the flow 40 being reduced to less than a first predetermined level.

The flow restriction tool 22 can also comprise a retaining device 52 that releasably retains the closure device 50 in the first position. The retaining device 52 may permit displacement of the closure device 50 from the first position to the second position in response to the flow rate being increased to greater than a second predetermined level.

The retaining device 52 may comprise at least one resilient collet 64. The biasing device 58 may comprise at least one resilient collet 74.

The closure device 50 can comprise a sleeve 72, and in the second position the flow 40 may pass through a wall of the sleeve 72 (e.g., via the openings 70).

The biasing device 58 can radially outwardly surround a generally conically shaped outer surface 54*a* connected to the closure device 50.

A well tool string 12 is also provided to the art by the above disclosure. In one example, the well tool string 12 can comprise: an orientation tool 18 that selectively permits and prevents fluid communication between an interior and an exterior of the tool string 12 and thereby transmits orientation data via multiple pressure pulses 30 in a flow passage 32 extending longitudinally through the well tool string 12; and a flow restriction tool 22 that permits flow 40 through a first flow area f1 when a flow rate of the flow 40 is less than a first predetermined level, and permits the flow 40 through a second flow area f1+f2 greater than the first flow area f1 when the flow rate is greater than a second predetermined level.

The flow restriction tool 22 may permit flow through the first flow area f1, but not the second flow area f1+f2, when the flow rate is reduced from above to below the first predetermined level.

A method of orienting a well tool string 12 in a well is also described above. In one example, the method can comprise: flowing fluid through the well tool string 12 at a flow rate, a flow restriction tool 22 restricting flow through the well tool string 12 and thereby producing a pressure differential from an interior to an exterior of the tool string 12, an orientation tool 18 selectively permitting and preventing fluid communication through a wall 28 of the well tool string 12 and thereby encoding orientation data; increasing the flow rate and thereby increasing a flow area through the flow restriction tool 22; and then decreasing the flow rate and thereby decreasing the flow area through the flow restriction tool 22 while still permitting flow through the flow restriction tool 22.

The step of increasing the flow area can include displacing a closure device 50 against a biasing force exerted by a biasing device 58. The step of displacing the closure device 50 can include deforming at least one collet 74 of the biasing device 58.

The step of decreasing the flow area can include retaining a closure device 50 in a position in which a flow passage 62 is blocked by the closure device 50. The step of retaining the closure device 50 can include engaging at least one resilient collet 64 of a retaining device 52.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A flow restriction tool for use in a subterranean well, the flow restriction tool comprising:

a closure device reciprocably displaceable between first and second positions in which flow is permitted longitudinally through the flow restriction tool, in the first position a first flow passage is open to the flow and the closure device blocks the flow through a second flow passage, and in the second position the first and second flow passages are open to the flow; and a biasing device which displaces the closure device to the first position in response to a flow rate of the flow being reduced to less than a first predetermined level.

2. The flow restriction tool of claim 1, further comprising a retaining device that releasably retains the closure device in the first position.

3. The flow restriction tool of claim 2, wherein the retaining device permits displacement of the closure device from the first position to the second position in response to the flow rate being increased to greater than a second predetermined level.

4. The flow restriction tool of claim 2, wherein the retaining device comprises at least one resilient collet.

5. The flow restriction tool of claim 1, wherein the biasing device comprises at least one resilient collet.

6. The flow restriction tool of claim 1, wherein the closure device comprises a sleeve, and in the second position the flow passes through a wall of the sleeve.

7. The flow restriction tool of claim 1, wherein the biasing device radially outwardly surrounds a generally conically shaped outer surface connected to the closure device.

8. A well tool string, comprising:

an orientation tool that selectively permits and prevents fluid communication between an interior and an exterior of the well tool string and thereby transmits orientation data via multiple pressure pulses in a flow passage extending longitudinally through the well tool string; and a flow restriction tool that permits flow through a first flow area when a flow rate of the flow is less than a first predetermined level, and permits the flow through a second flow area greater than the first flow area when the flow rate is greater than a second predetermined level.

9. The well tool string of claim 8, wherein the flow restriction tool permits flow through the first flow area, but not the second flow area, when the flow rate is reduced from above to below the first predetermined level.

10. The well tool string of claim 8, wherein the flow restriction tool comprises a closure device reciprocably displaceable between first and second positions, in the first position a first flow passage is open to the flow and the closure device blocks the flow through a second flow passage, and in the second position the first and second flow passages are open to the flow.

11. The well tool string of claim 10, wherein the flow restriction device further comprises a biasing device which displaces the closure device to the first position in response to the flow rate being reduced to less than the first predetermined level.

12. The well tool string of claim 11, wherein the biasing device comprises at least one resilient collet.

13. The well tool string of claim 10, wherein the flow restriction tool further comprises a retaining device that releasably retains the closure device in the first position.

14. The well tool string of claim 13, wherein the retaining device permits displacement of the closure device from the first position to the second position in response to the flow rate being increased to greater than the second predetermined level.

15. The well tool string of claim 13, wherein the retaining device comprises at least one resilient collet.

16. A method of orienting a well tool string in a well, the method comprising:

flowing fluid through the well tool string at a flow rate, a flow restriction tool restricting flow through the well tool string and thereby producing a pressure differential from an interior to an exterior of the well tool string, an orientation tool selectively permitting and preventing fluid communication through a wall of the well tool string and thereby encoding orientation data;

increasing the flow rate and thereby increasing a flow area through the flow restriction tool; and then decreasing the flow rate and thereby decreasing the flow area through the flow restriction tool while still permitting flow through the flow restriction tool.

17. The method of claim 16, wherein increasing the flow area comprises displacing a closure device against a biasing force exerted by a biasing device.

18. The method of claim 17, wherein displacing the closure device comprises deforming at least one collet of the biasing device.

19. The method of claim 16, wherein decreasing the flow area comprises retaining a closure device in a position in which a flow passage is blocked by the closure device.

20. The method of claim 19, wherein retaining the closure device comprises engaging at least one resilient collet of a retaining device.

* * * * *